US007600948B2

(12) United States Patent
Cargill et al.

(10) Patent No.: US 7,600,948 B2
(45) Date of Patent: Oct. 13, 2009

(54) MICROPILE RETAINING WALL

(75) Inventors: Kevin W. Cargill, Marietta, GA (US); Stephen L. Dimino, Marietta, GA (US)

(73) Assignee: Schnable Foundation Company, Sterling, VA (US)

( * ) Notice: Subject to any disclaimer, the term of this patent is extended or adjusted under 35 U.S.C. 154(b) by 163 days.

(21) Appl. No.: 11/551,156

(22) Filed: Oct. 19, 2006

(65) Prior Publication Data

US 2007/0092343 A1 Apr. 26, 2007

Related U.S. Application Data

(60) Provisional application No. 60/727,846, filed on Oct. 19, 2005.

(51) Int. Cl.
*E02D 29/02* (2006.01)

(52) U.S. Cl. ..... 405/262; 405/284; 405/285

(58) Field of Classification Search ..... 405/262, 405/284–287

See application file for complete search history.

(56) References Cited

U.S. PATENT DOCUMENTS 3,807,182 A * 4/1974 Schnabel, Jr. ..... 405/259.1
RE28,977 E * 9/1976 Mason ..... 405/262
5,244,316 A * 9/1993 Wright et al. ..... 405/285
5,551,810 A * 9/1996 Franceski et al. ..... 405/286
5,588,784 A * 12/1996 Brandl et al. ..... 405/262
5,634,308 A * 6/1997 Doolan ..... 52/334
6,299,386 B1 * 10/2001 Byrne et al. ..... 405/262
2005/0271480 A1 * 12/2005 Irvine ..... 405/285
2006/0010819 A1 * 1/2006 Irvine et al. ..... 52/583.1

OTHER PUBLICATIONS

Dino Kartofills, Brian O'Gara, Fred Tarquinio and John Wise, Cover Feature, Titus Power Plant Micropile Retaining Wall, pp. 10-13, ADSC, Feb. 2006.

Implementation Manual, US Department of Transportation Federal Highway Administration Priority Technologies Program, Micropile Design and Construction Guidelines, Publication No. FHWA-SA-97-070 (v00-06), 5 sheets, Jun. 2000.

Civil Engineering, Oct. 2005.

* cited by examiner

*Primary Examiner*—Frederick L Lagman
(74) *Attorney, Agent, or Firm*—Banner & Witcoff, Ltd.

(57) ABSTRACT

The present invention provides a permanent earth retaining wall having small diameter casings that remain in the ground to become vertical micropile soldier beams of the retaining wall, and a method for forming a retaining wall. The method includes a top-down method of constructing a retaining wall. The retaining wall may be constructed by placing a plurality of relatively small diameter micropile casings into the ground using overburden percussion drilling methods. The casings are configured to remain in the ground and form micropile soldier beams of the retaining walls. Tiebacks may be coupled to the micropiles via horizontal support wales that span multiple micropiles.

20 Claims, 18 Drawing Sheets

MICROPILE RETAINING WALL

CROSS REFERENCE TO RELATED APPLICATIONS

This application is a non-provisional of provisional application No. 60/727,846 filed Oct. 19, 2005, which is incorporated herein by reference.

FIELD OF THE INVENTION

The present invention relates to earth retaining walls and methods for installing such walls. In particular, the present invention pertains to permanent earth retaining walls having substantially vertical micropile soldier beams and lateral-load support elements, such as tiebacks.

BACKGROUND

Roadways throughout the United States often must be constructed through mountainous or hilly terrain. Typical construction methods for these types of roadways involves blasting rock away from the uphill side of the mountain and using this blasted rock and soil in the construction of the road. The blasted rock fill is often placed on top of steep terrain and used to form the roadway. When the fill becomes unstable and slides away from the roadway, it forms a landslide. Landslides are dangerous and problematic in that they can disrupt the normal flow of traffic along these roadways, which are often major thoroughfares.

When such landslides occur, they must be stabilized in order to return the roadway to normal, usable conditions. In order to stabilize the landslide, a tiedback retaining wall is often constructed. Permanent soldier beam and tieback retaining walls are known in the art and have been constructed to stabilize landslides or for other earth retaining purposes.

Conventional permanent earth retaining walls for landslide stabilization use large-diameter drilled shafts for soldier beams. The soldier beams are formed in an open drilled shaft or they are formed in a cased drilled shaft. These conventional soldier beams either consist of a steel beam placed in the drilled shaft and surrounded by a cementaceous material or they consist of a reinforcing bar cage placed in the drilled shaft and filled with structural concrete. If casing is used, it is removed after the cementaceous material of concrete is placed. The direct interaction between the cementaceous material or structural concrete and the ground enhances the soldier beam's bond to the ground.

When these conventional soldier beams are installed in caving ground with hard boulders, such as is found in landslides in mountainous terrain, special drilling methods must be used to install the drilled shaft. These special drilling methods are commonly known as overburden, percussion drilling methods, which permit a casing to be advanced as the shaft is drilled. They do so by drilling a hole having a larger diameter than the casing. A structural steel soldier beam is set inside the casing and the hole is backfilled with cementaceous material or structural concrete. Then the casing is removed leaving a steel soldier beam in a cementaceous material filled hole in direct contact with the ground. Another method of creating the soldier beam is to insert a reinforcing bar cage into the cased hole and filling the casing with structural concrete. Then the casing is removed leaving a structural concrete soldier beam in direct contact with the ground. After the casing is removed, the large drilling equipment is moved to another soldier beam location.

Installing large diameter soldier beams requires overburden percussion drilling equipment that is large enough to advance a cased drill shaft 24 to 36 inches in diameter or larger. The difficult ground conditions and large equipment required to support such drilling make constructing these types of retaining walls expensive and time consuming. In addition, such large size drilling equipment requires a considerable amount of space in which to set the equipment while constructing the wall. Often, landslides requiring retaining walls occur on major roadways that have limited space in which to work. The issue of limited space is compounded when the roadway must remain open to traffic, even if only to limited traffic flow. Often, using such large diameter equipment necessitates complete or partial road closure, which causes severe traffic flow disruptions.

Tiebacks have been used with conventional soldier beam retaining walls to provide lateral support to the wall. The tiebacks of conventional permanent retaining walls with concrete faces are directly attached to the vertical soldier beams. In some applications, the drilled shafts are installed from an elevation near the bottom of the wall and the permanent tiedback earth retaining wall is constructed via bottom-up methods. Bottom-up methods require installation of the facing and backfill behind the wall from the bottom of the wall toward the top of the wall.

Piles having a relatively small diameter, known as micropiles, are known to be used for the stabilization of landslides in non-retaining wall circumstances. In one conventional configuration, they generally stabilize a slide without forming a retaining wall. In another configuration, tiebacks, installed in a common cap beam with the micropiles, are used to provide additional lateral support for the micropiles.

In another conventional configuration, a large number of individual micropiles are applied to unstable ground so that it functions as a united mass. In this configuration the micropiles are small diameter, low structural capacity micropiles formed of a grouted bar rather than a steel casing. The mass of the reinforced ground with the large number of micropiles can be large enough to function as a gravity earth retaining structure, without an exposed structural wall face.

BRIEF SUMMARY

Aspects of the present invention provide a retaining wall having small diameter casings that remain in the ground to become vertical micropile soldier beams of the retaining wall. In addition, aspects of the invention provide a method for forming a retaining wall, which may include a top-down method of constructing a retaining wall.

In one example embodiment of the present invention, a retaining wall is constructed by placing a plurality of sectional casings into the ground using overburden percussion drilling methods. The casings may include micropile casings having relatively small diameters that are configured to remain in the ground and form micropile soldier beams of the retaining walls.

Tiebacks are connected to horizontal support members. The horizontal support members are connected to vertical micropile soldier beams. The horizontal support members may include horizontal wales that span multiple micropile soldier beams.

The horizontal support members may be formed using cast-in-place concrete or shotcrete. In one particular arrangement, the tiebacks are connected to the horizontal wales. The horizontal wales are then connected to the micropile soldier beams.

Other features and advantages of various aspects of the invention may become apparent with reference to the following detailed description and figures.

DETAILED DESCRIPTION OF THE DRAWINGS

The various aspects of the invention may be embodied in various forms. The following description shows by way of illustration various embodiments and configurations in which aspects of the invention may be practiced. It is understood that other embodiments may be utilized and structural and functional modifications may be made without departing from the scope of the present invention. For example, it is understood that embodiments of the invention may include one or more aspects of the invention described herein in various combinations.

Figure 4:
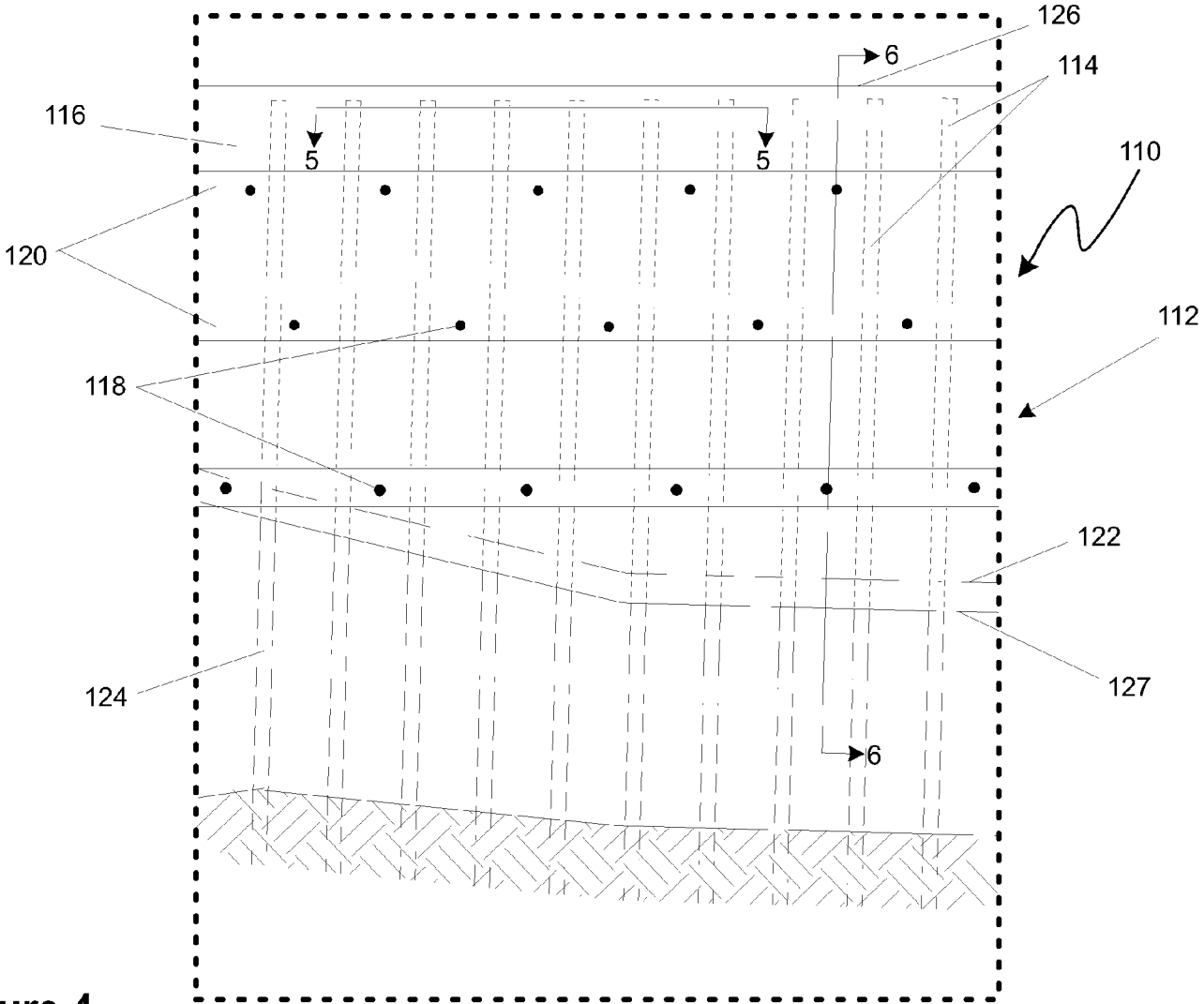
FIG. 4 is an elevational view of a section of the retaining wall of FIGS. 2 and 3.

FIGS. 1-7 show an example retaining wall 110 that illustrates various aspects of the present invention. An enlarged section 112 of the retaining wall is shown in FIG. 4 for discussion purposes. As shown, retaining wall 110 generally includes a plurality of micropile soldier beams 114, facing 116 connected to the micropile soldier beams, tiebacks 118 connected to the horizontal supports, and wales 120 to transfer the tieback loads to the micropile soldier beams 114.

The structural facing 116 is preferably formed from a reinforced structural shotcrete or cast-in-place concrete material. In one arrangement, a combination of shotcrete and cast-in-place concrete can be used to form the structural facing. The facing 116 is connected to the micropile soldier beams 114 and serves to support the soil between the micropile soldier beams 114. Preferably, the facing extends from a top portion of the wall 126 to a bottom portion of the wall 127, which may be located at a desired distance below grade 122. In addition, as discussed along with FIGS. 8-18, the use of shotcrete can provide great flexibility for forming the retaining wall using a top-down method and for connecting the tiebacks to the wall. The use of shotcrete along with a top-down construction method can eliminate the need for temporary lagging between micropile soldier beams. Drainage is provided behind the facing to prevent the buildup of water pressures behind the wall. Various prefabricated drains are known and used in the art. For example, a Midadrain prefabricated drain system may be used in one arrangement.

Figure 5:
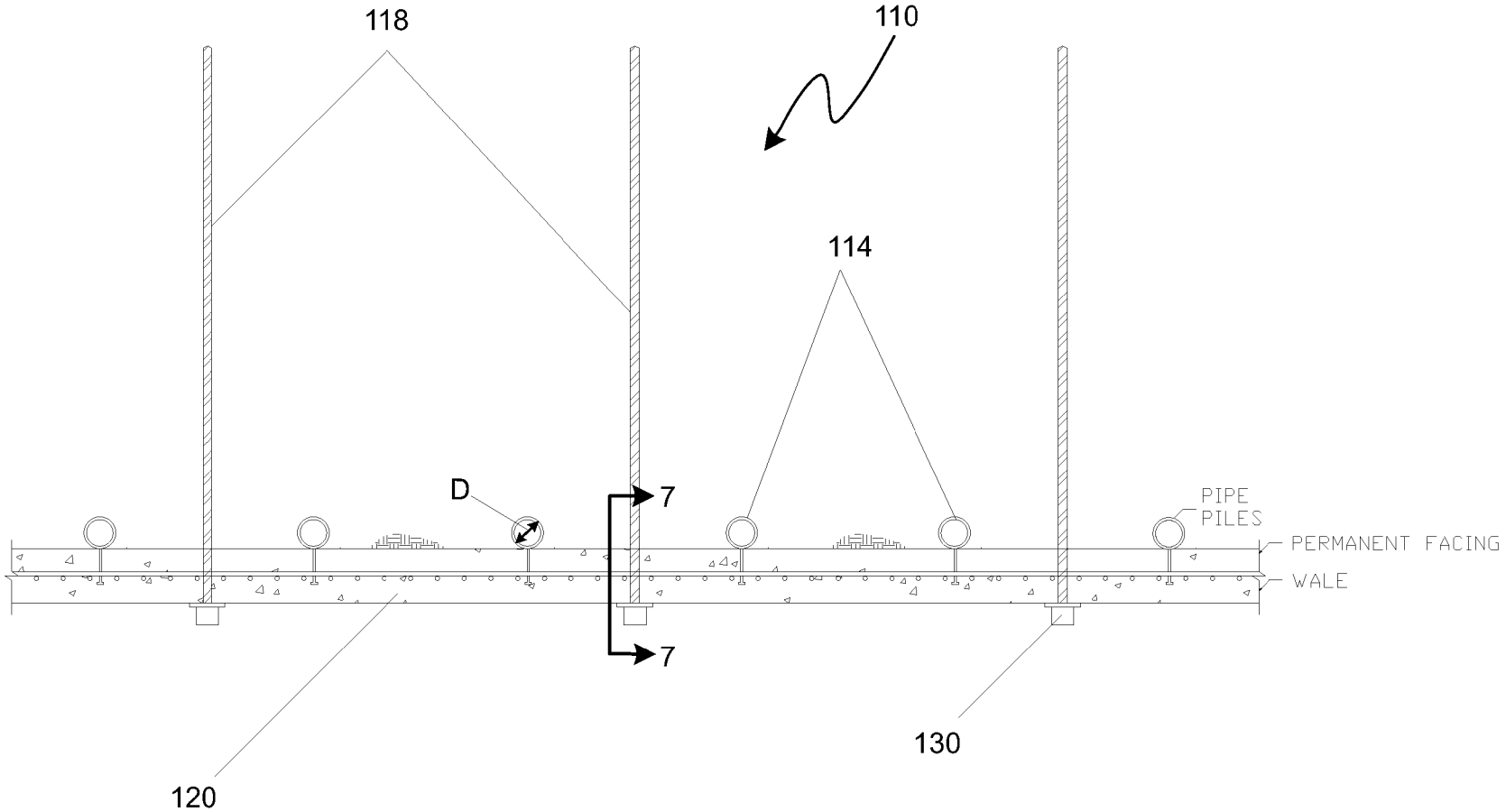
FIG. 5 is a top sectional view taken along line 5-5 of the retaining wall section of FIG. 4.

As shown in FIG. 5, the micropile soldier beams can be formed from a plurality of casings, such as round sectional steel casings, that have a relatively small diameter D and are placed substantially vertically in the ground to form vertical micropile soldier beams. The steel casings or pipe piles may have a diameter D from 6 inches to 14 inches, and may preferably have a diameter from 8 inches to 12 inches. In one configuration, the steel casings are formed of 10¾" O.D.× 0.595 wall steel tubing or an equivalent. The casings can be sectional casings that are connected via a threaded connection or other type of structural connection. The steel casings may include additional sacrificial steel to allow for corrosion resistance. In addition, the steel casings may be filled with grout to provide additional corrosion resistance and to improve compression loading characteristics.

The use of micropiles formed from small-diameter casings can provide several advantages for the retaining wall and for its installation. The steel casings, particularly with increased wall thicknesses such as 0.5 inches or more, can provide good loading, stiffness, shear and bending characteristics. When the lower portion of the micropile soldier beam is grouted in-place, such micropiles can provide good soil-to-micropile soldier beam bonds, and develop substantial vertical load carrying capacity. In addition, such micropiles can be particularly advantageous for use in rocky terrain due to the ease with which they can be installed compared to larger diameter piles.

Percussion overburden drilling equipment for small diameter micropile soldier beams is relatively inexpensive when compared to the cost of drilling large diameter holes through caving rock fills and bouldery ground for large conventional soldier beams. Overburden drilling equipment for micropiles employs a combination of percussion drilling in conjunction with rotational drilling, which can be operated using relatively small drilling equipment that can operate in a more limited space than equipment used to drill large conventional drilled shafts.

Figure 1:
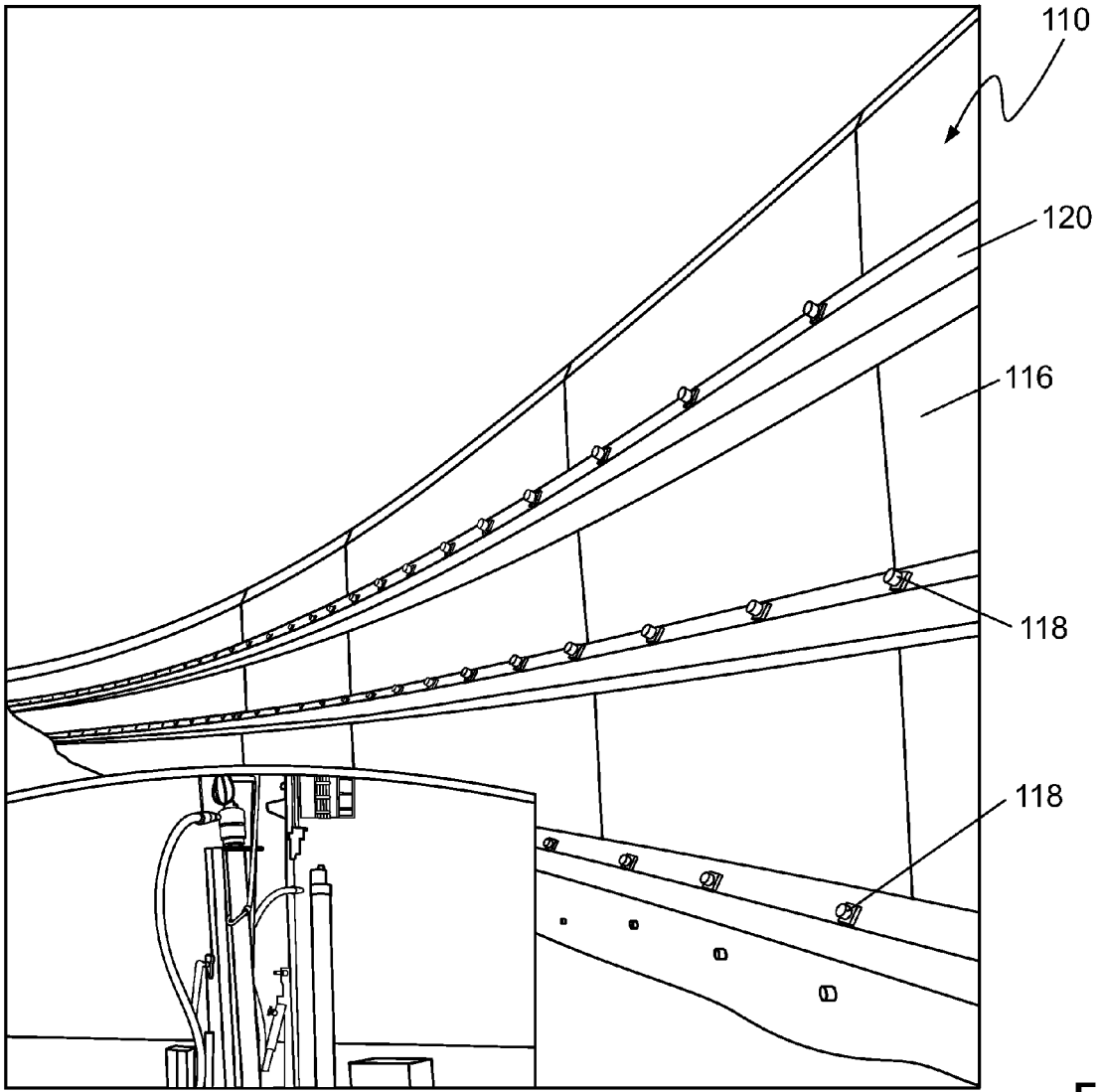
FIG. 1 is an elevational perspective view of a sample retaining wall in which aspects of the present invention may be implemented.
Figure 2:
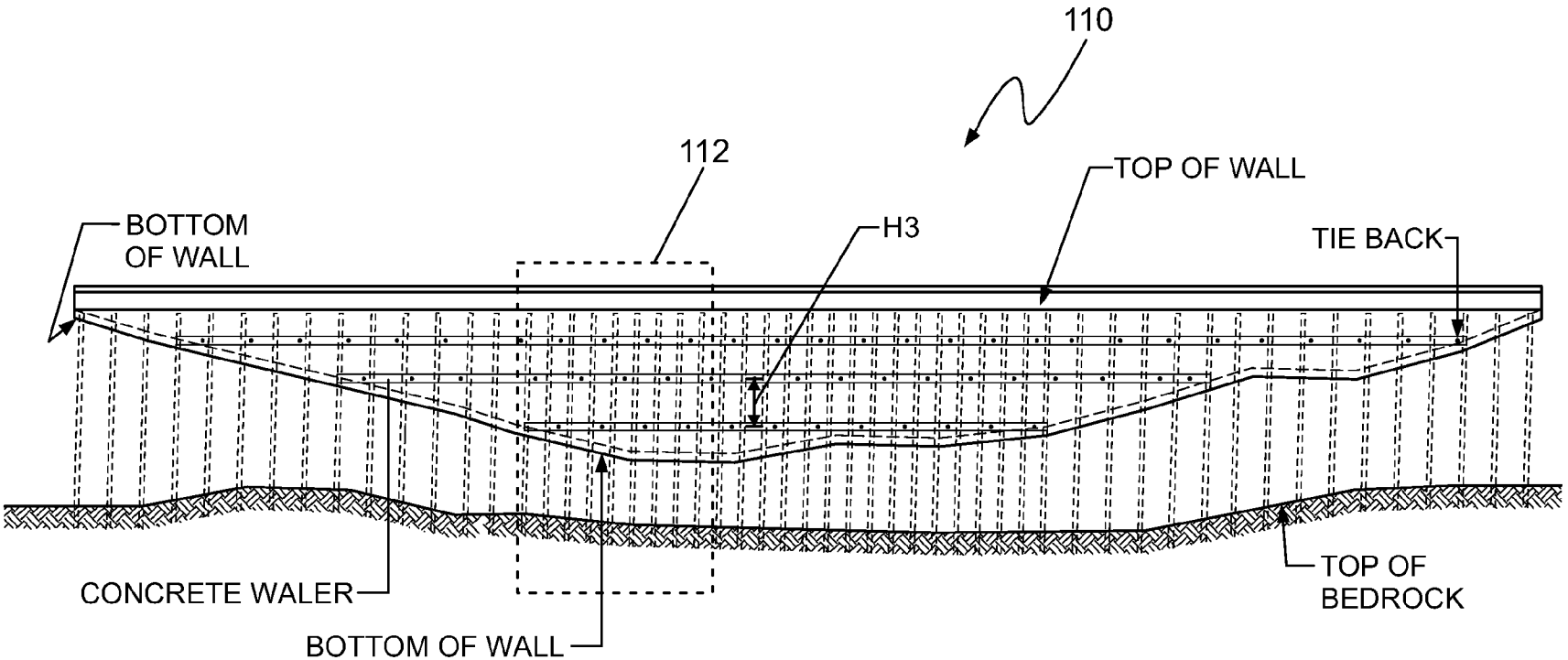
FIG. 2 is an elevational view of the retaining wall of FIG. 1.
Figure 3:
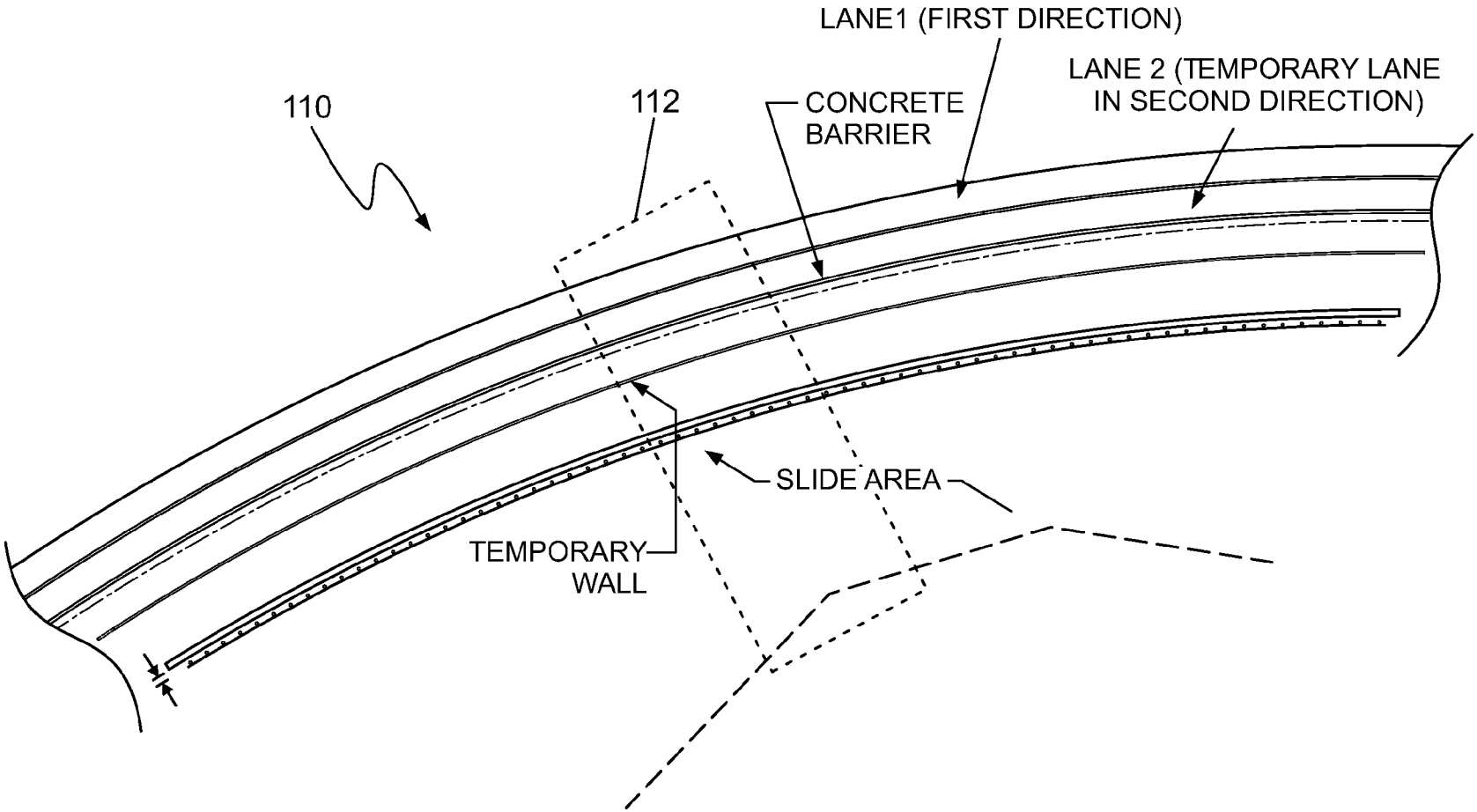
FIG. 3 is a top view of the retaining wall of FIG. 1.

As shown in FIGS. 4 and 5, micropiles 114 are placed at regular intervals along the length of the wall in a serial configuration. The micropiles are installed to a sufficient depth to provide vertical, lateral, and bending support to the retaining wall according to the type of soil and its configuration, loading, pressure. Preferably, as shown in FIGS. 2 and 4, the micropiles extend a desired distance into an undisturbed ground 129, such as a layer of bedrock or competent ground below the bottom of the wall 127. Once placed in the ground, the micropiles can provide retention support to the caving ground while drilling and other installation operations, and provide temporary support of the ground between the micropiles during excavation and prior to installing the facing 116.

As further shown in FIGS. 4 and 5, one or more wales 120 may be used to transfer the tieback load to the micropiles. The wales 120 span across multiple micropiles. The wales are preferably formed from reinforced structural concrete or shotcrete. The wales are formed against the exposed outer surface of the micropiles and they are structurally connected to the micropiles. The wales can extend the length of the wall as desired. Due to the exposed nature of the wales, use of concrete or shotcrete in forming the wales provides a more durable support member than steel or other materials. For instance, concrete or shotcrete resists corrosion when exposed to various environmental elements, unlike steel. In addition, use of structural concrete or shotcrete wales provides a uniform appearance for the exposed surface of the retaining wall. This allows for an aesthetically pleasing appearance for a retaining wall, which is particularly useful when the retaining wall is a permanent structure.

The wales can provide a large degree of design, installation and structural freedom to the retaining wall by permitting the tiebacks to connect with the wall at a large variety of locations. Tiebacks are attached to the soldier beams of conventional retaining walls. As shown in the example of FIG. 5, tiebacks 118 can attach directly to one of the wales 120, which are connected to the micropiles. Tiebacks are preferably installed under tension and thus provide lateral stability to the retaining wall via their connection with the wales. This permits the tiebacks to be installed at various advantageous locations and at advantageous times during installation of the retaining wall.

Figure 7:
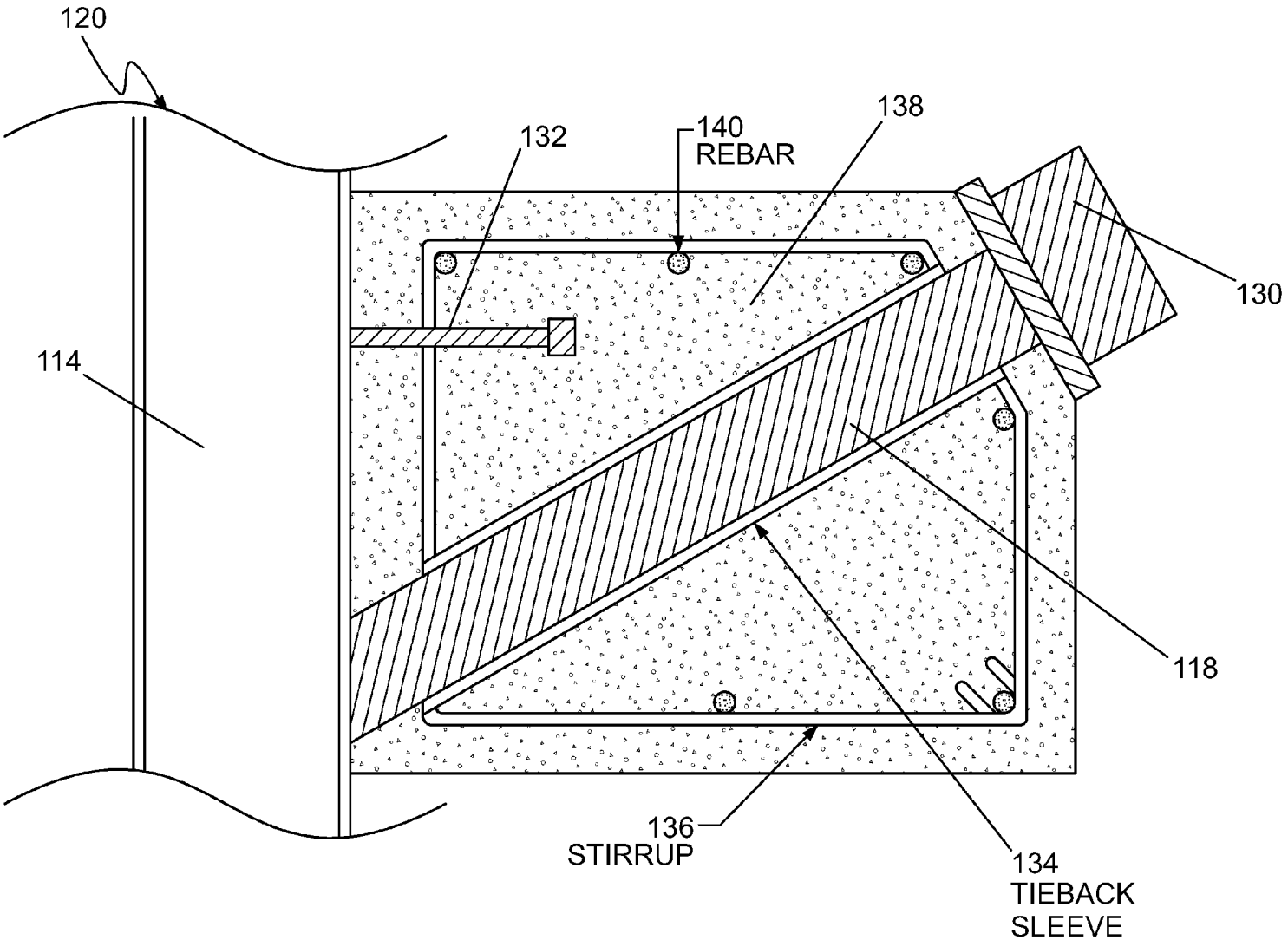
FIG. 7 is an elevational sectional view taken along line 7-7 of the retaining wall section of FIG. 5 showing a cross-section of the retaining wall wale.

As shown in FIG. 7, wales 120 are preferably formed of concrete or shotcrete and include reinforcing bars 140. The wales can be attached to micropile soldier beams via headed studs 132, or via welded structural steel members, such as a Tee section.

In one arrangement, studs such as NELSON STUDS which extend from the soldier beams, may be used to attach the wales. The tiebacks are anchored in the ground behind a failure surface and extend through respective wales. The tiebacks are formed from post-tensioning steel tendons and they are tested and stressed against the wale. An anchorage 130 and associated bearing plate, are used to transfer the tieback load to the wale. In one arrangement, the anchorage is embedded in the concrete or shotcrete wale 120 to maintain the uniform, aesthetic appearance of the exposed surface of the retaining wall. In addition, encasing the anchorage in the concrete or shotcrete wale prevents corrosion of the steel and adds to useful life of the retaining wall.

Figure 6:
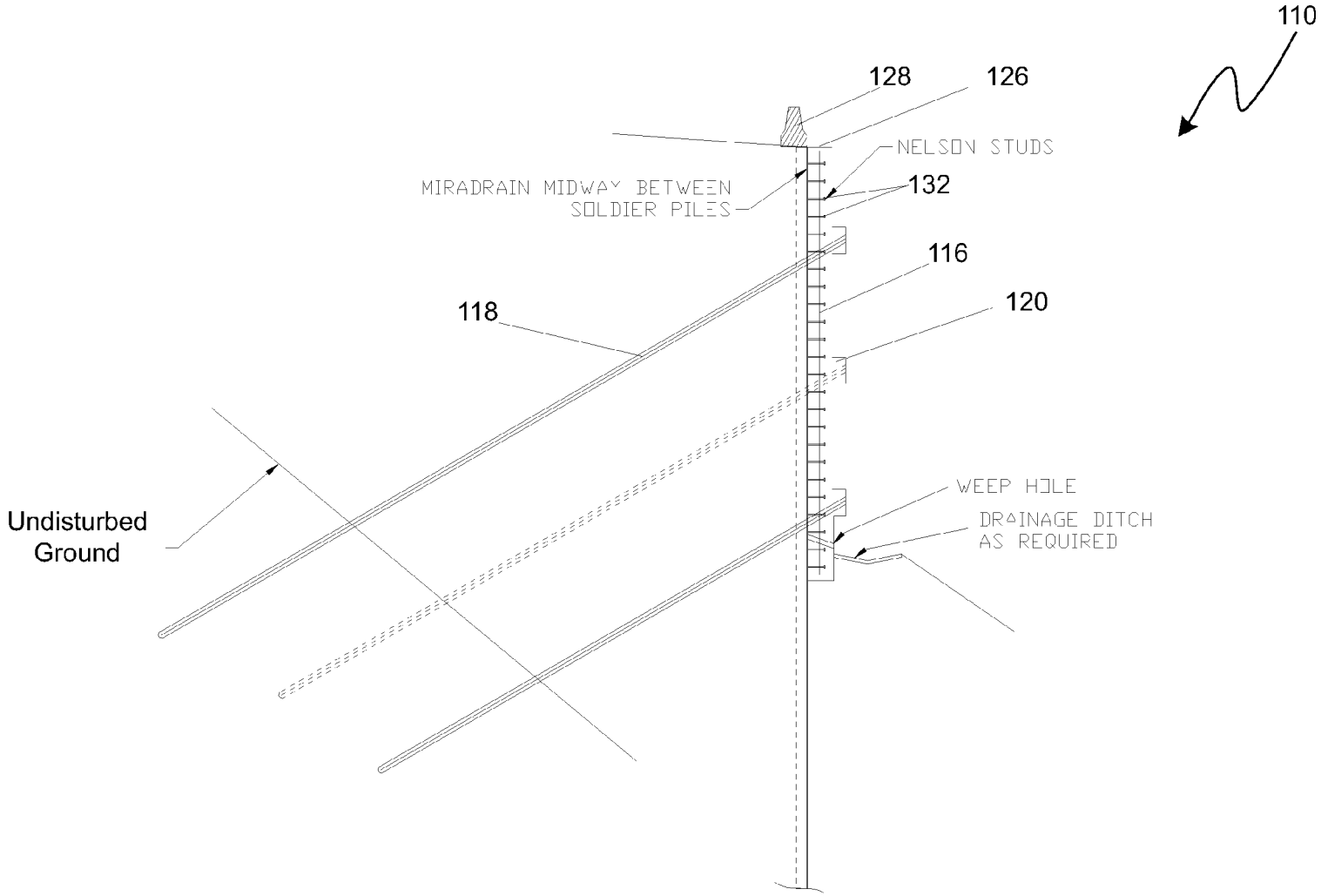
FIG. 6 is an elevational sectional view taken along line 6-6 of the retaining wall section of FIG. 4.

As shown in FIG. 6, tiebacks 118 provide lateral support to anchor the retaining wall in place. The tiebacks preferably extend a certain distance into the undisturbed ground behind the wall at an angle that is less than 90 degrees relative to the retaining wall. In one particular arrangement, the tiebacks extend into the undisturbed ground behind the wall at an angle between 5 and 45 degrees from the horizontal. The tiebacks can be anchored into the undisturbed ground and be placed under tensile load between their anchor and their anchorage. The tiebacks can be installed through their respective wale 120 to anchor the retaining wall.

The concrete wales provide horizontal support along the length of the retaining wall. The tiebacks are anchored to the retaining wall via the wales. Thus, the wales serve to transfer the anchor load to the micropile soldier beams and permit the tiebacks to be attached at almost any position along the length of the retaining wall.

A plurality of tiebacks are installed along the length of the retaining wall. The tiebacks are installed through the wales and extend a given distance through the earth being supported, into undisturbed ground. The tiebacks are tensioned and the load is transferred to the wale to support the retaining wall.

The reinforced structural concrete or shotcrete facing is installed on the wall between the vertical micropile soldier beams. No temporary lagging is required when using this shotcrete method. The facing is structurally connected to the micropile soldier beams and is designed to support the ground between the micropiles. Headed studs may be used to connect the facing to the micropiles.

Construction of the wall begins at the top-most section of the wall. Once construction of that section is completed, construction moves to the next section below the completed section. Excavation in front of the wall is necessary to expose the micropiles in preparation for construction of the next wall section below. Construction continues in this fashion, completing each section below the one above, until all sections are constructed. Constructing the wall in sections and locating the tiebacks vertically along the walls allows the wall to be used to support deep slides that may not be well supported by conventional micropile arrangements, e.g., arrangements in which tiebacks are connected to a cap beam.

The small diameter casings used as micropile soldier beams allow for small diameter overburden drilling equipment to be used. This equipment requires less space in which to operate. Additionally, leaving the casings in the ground allows for cost and time savings in not requiring the additional labor associated with pulling the casings and additional materials of installing a steel beam or reinforced concrete drilled shaft.

Referring now to FIGS. 8-18, a method 800 for installing a permanent retaining wall is generally illustrated. For discussion purposes, permanent retaining wall 110 will be referred to as the retaining wall. However, method 800 may be used with other retaining walls. In addition, it is understood that method 800 illustrates various aspects of the invention that may be practiced in various combinations. As illustrated in FIGS. 9 and 11-18, retaining wall 110 is preferably constructed in a top-down methodology. Such a method provides several advantages. For instance, a top-down method avoids the need to remove fill material prior to installing the wall and provides support for the ground behind the wall through each step of construction. In addition, it can permit a retaining wall to be installed much faster and inexpensively than may be done with a bottom-up methodology.

Figure 8:
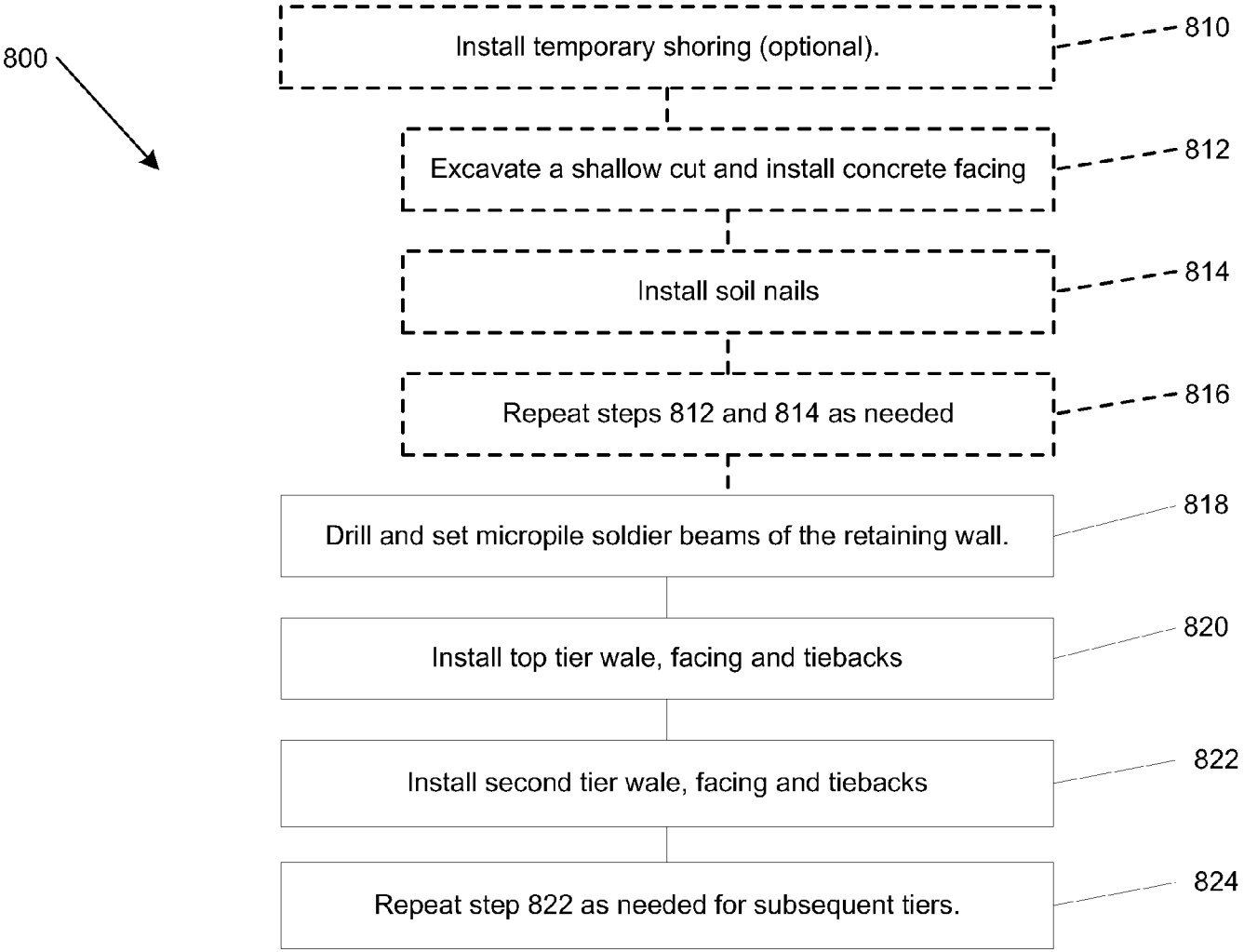
FIG. 8 shows a method for forming a retaining wall according to aspects of the invention.
Figure 11:
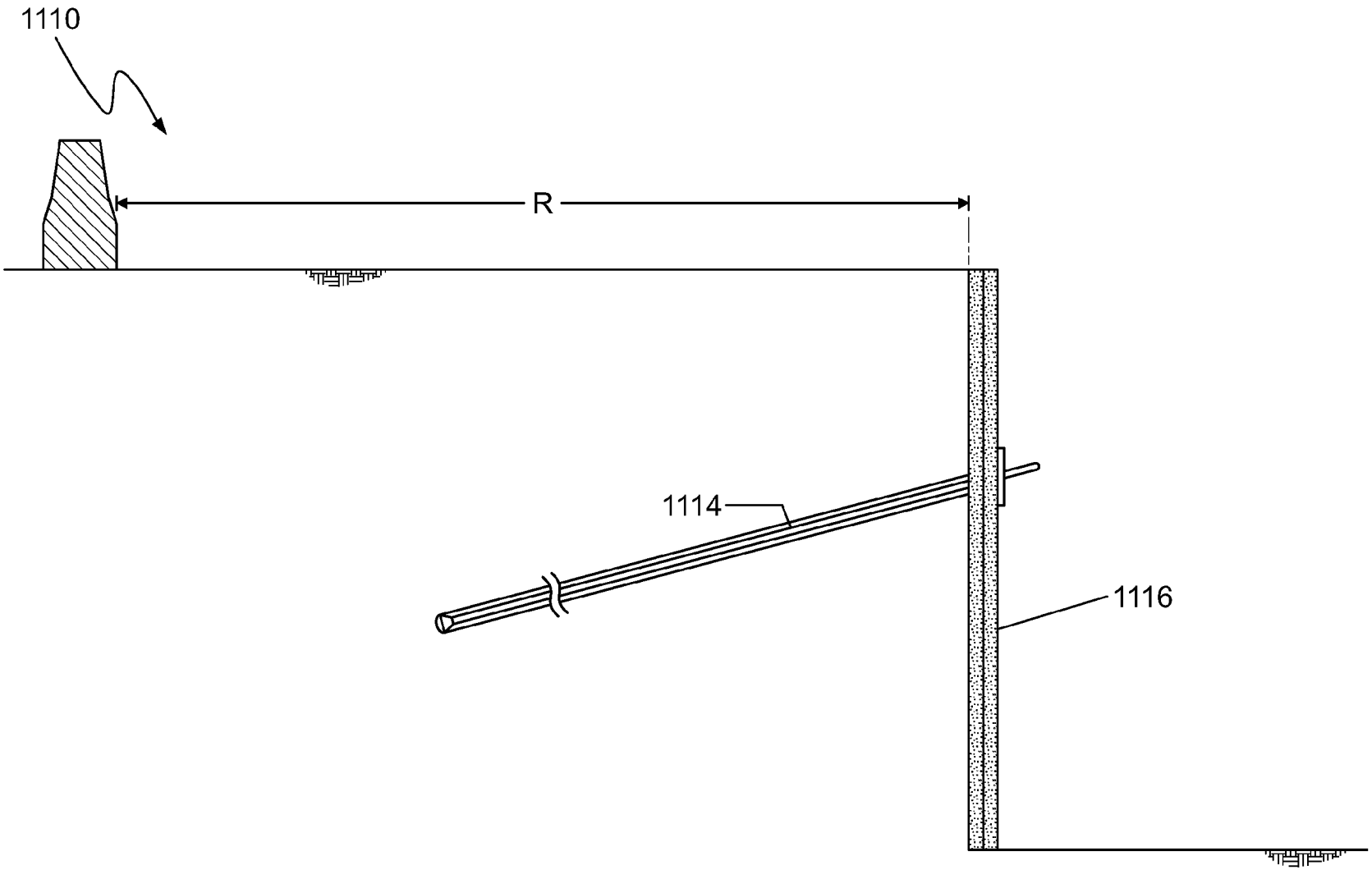
FIG. 11 is an elevational view of an optional shoring wall that may be used with the method of FIG. 8.

As shown in FIG. 8, an optional initial step may include the step 810 of installing temporary shoring. Such a step may be necessary to provide support for installation equipment or to avoid further degradation of the slope. FIG. 11 illustrates such a temporary shoring 1110, which generally includes soil nailing. Soil nailing may include installing an untensioned reinforcement in the ground and connecting the reinforcement to a thin reinforced shotcrete facing. The temporary shoring provides a bench surface that is a sufficient distance R from a roadway or other area of concern.

In order to install temporary shoring 1110 according to method 800, an initial step 812 includes excavating a shallow cut and applying shotcrete facing 1116 to the cut.

Figure 9:
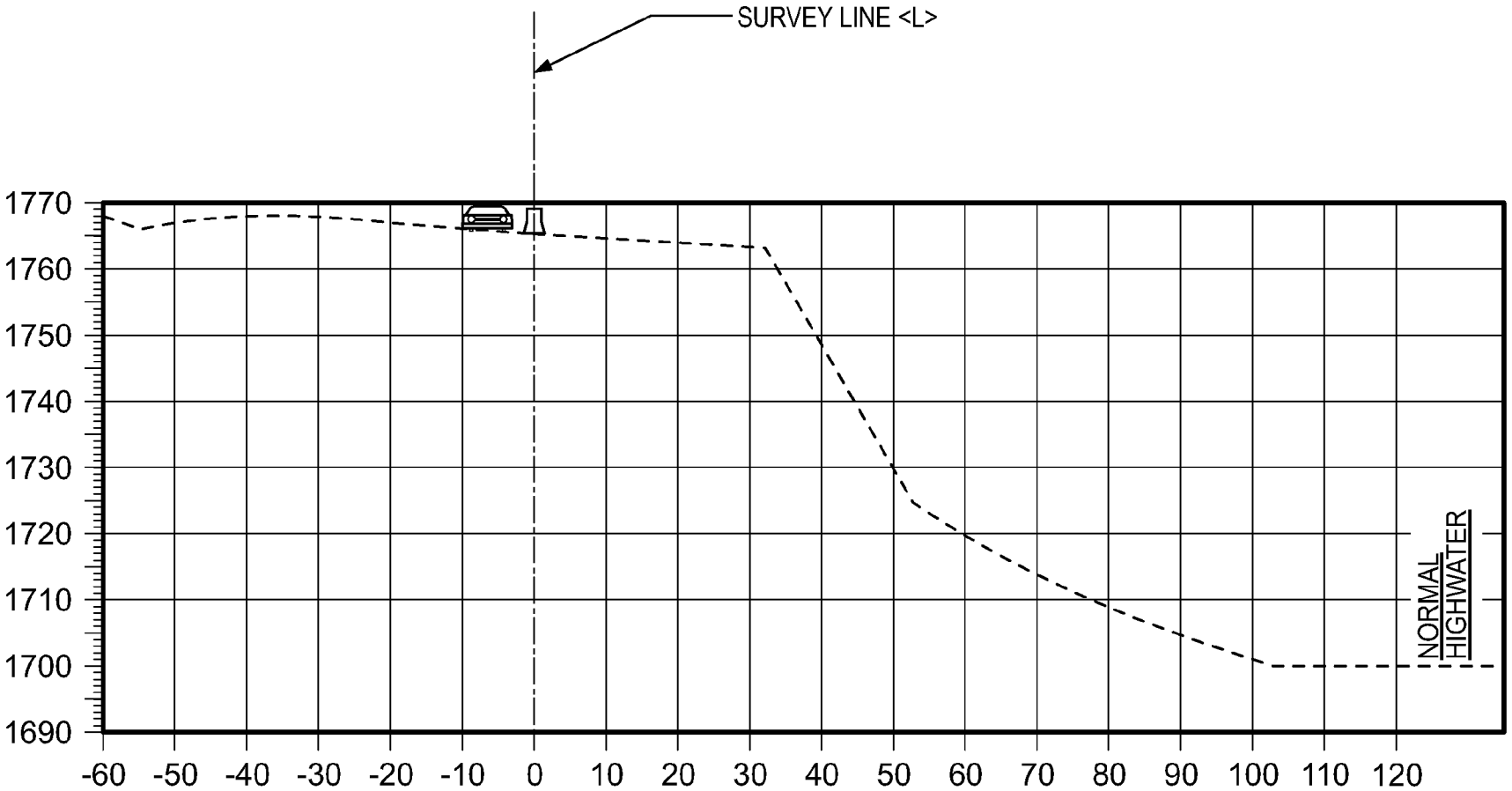
FIGS. 9, 10 and 12-18 show elevational views of steps of the method of FIG. 8.
Figure 10:
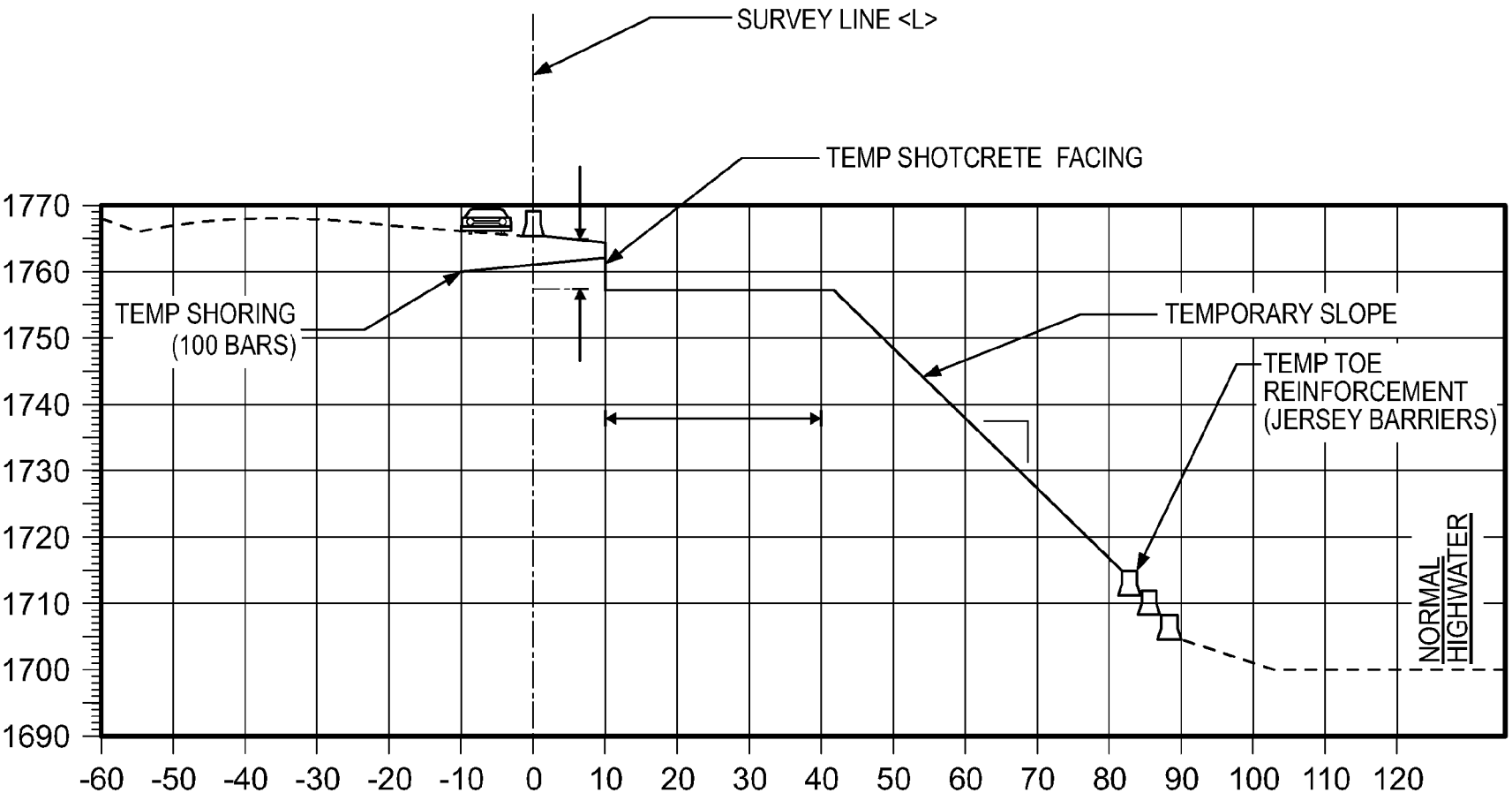

Subsequent steps include the step 814 of installing soil nails 1114. The order of installing the facing and the soil nails may be switched. If additional depth is required, then step 816 can be repeated as necessary to install additional shotcrete facing and soil nails. FIG. 9 illustrates a starting point for the slope and FIG. 10 shows the slope after installation of temporary shoring 1110.

Figure 12:
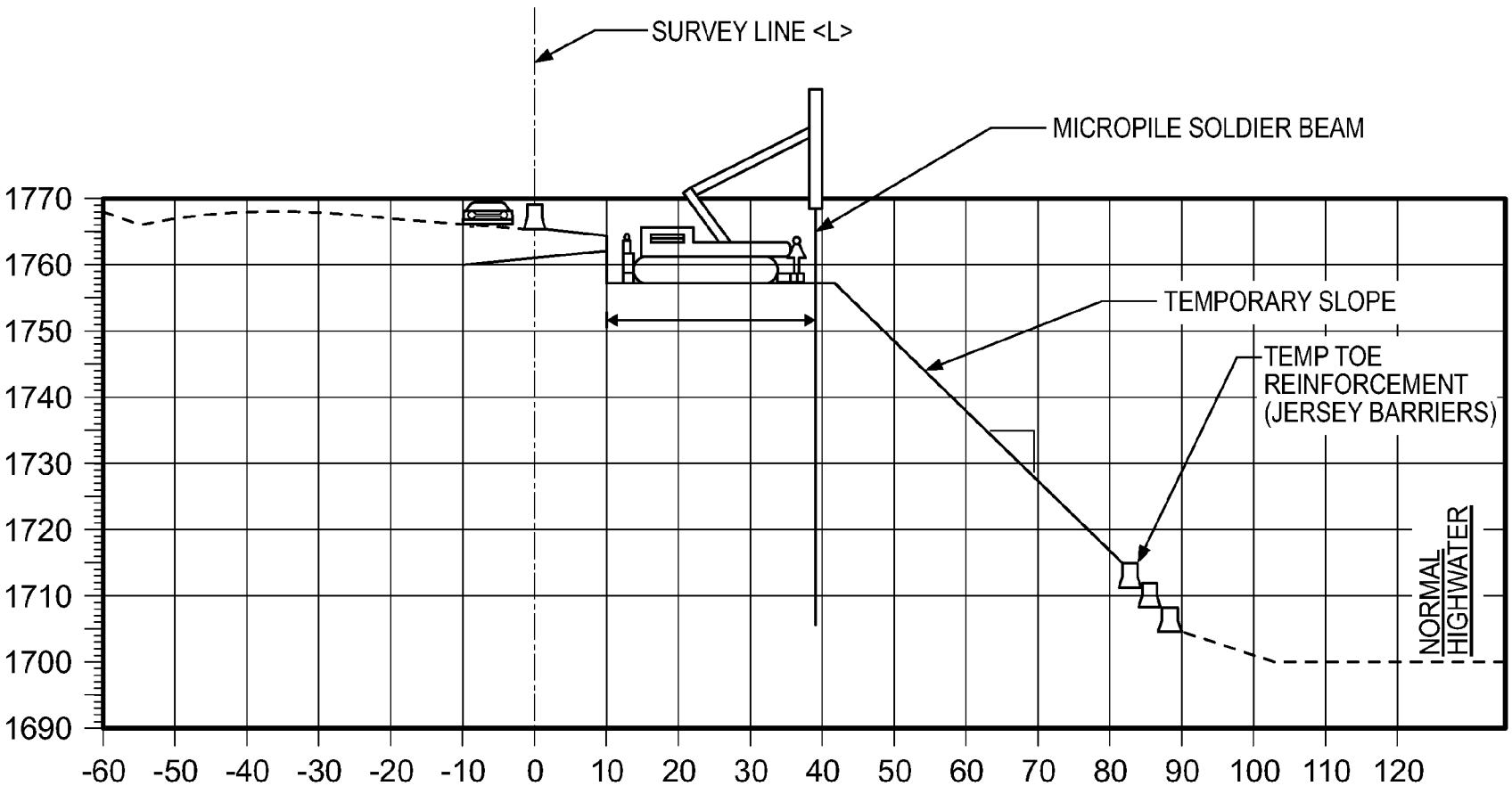
Figure 13:
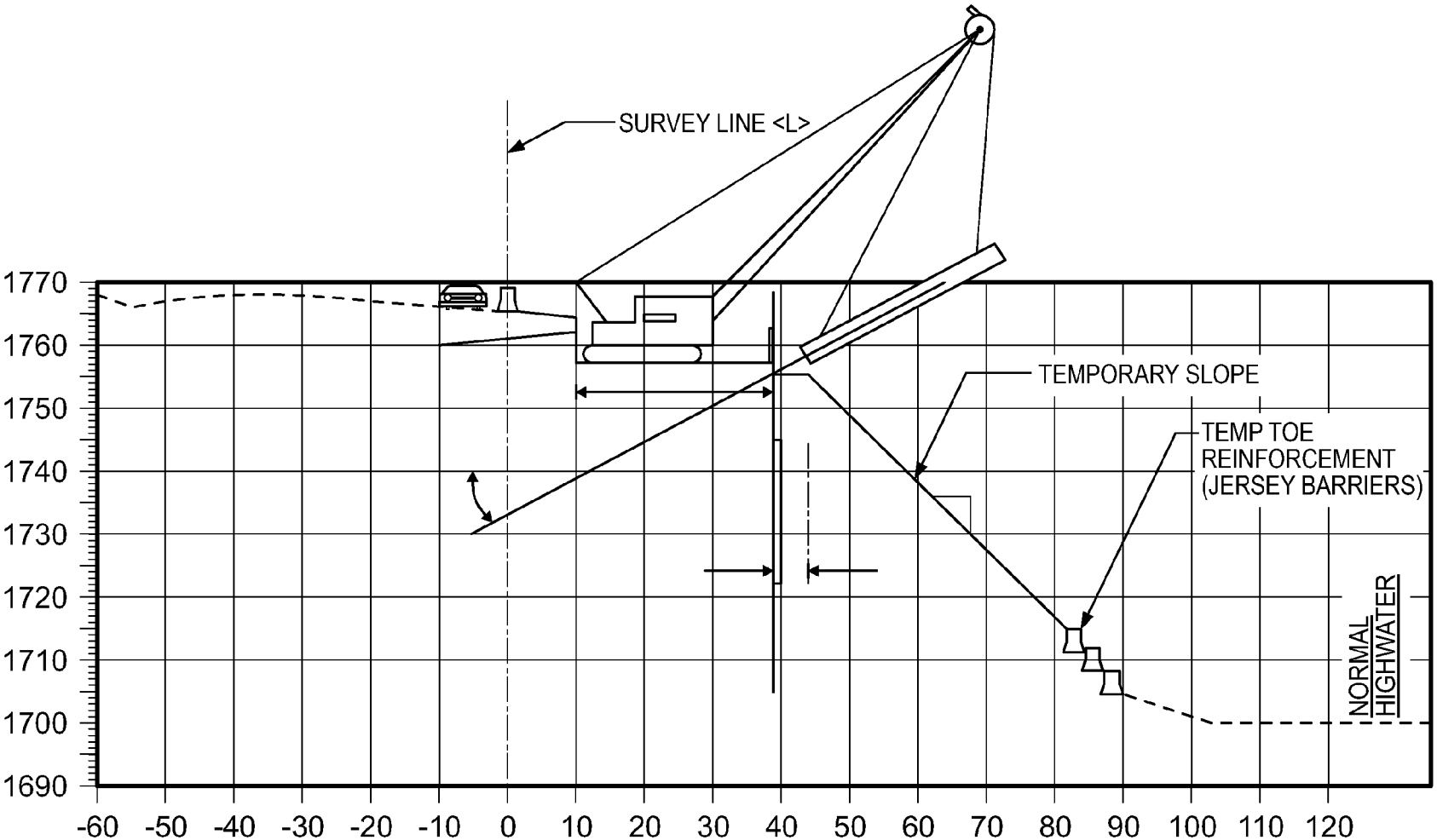
Figure 14:
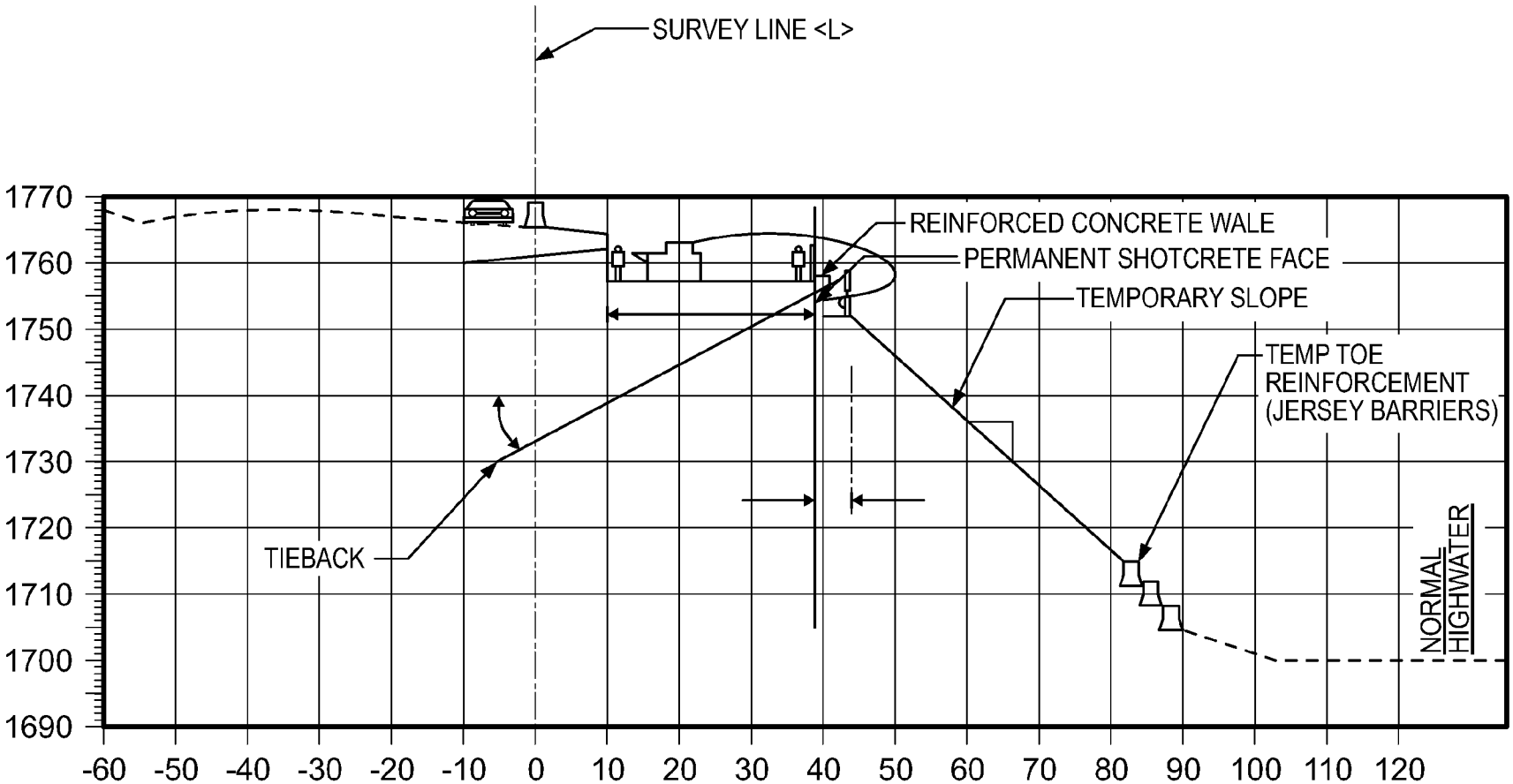

FIG. 12 illustrates the next step 818 of drilling and setting the micropile soldier beams, which may include a steel pipe, a steel tube, or a sectional steel drill casing. The micropiles are placed single file along the length of the retaining wall. After drilling and placing the micropiles, they are preferably filled with concrete or grout to form the micropile soldier beams. The next step 820 includes installing wales, tiebacks and facing at an upper section as shown in FIGS. 13 and 14, which preferably include forming a reinforced structural concrete or shotcrete facing between and outside of the micropiles and constructing a reinforced structural concrete or shotcrete wale attached to the micropile soldier beams. Headed studs may be used to attach the facing and the wale to the micropile soldier beams. The tiebacks are also attached to concrete wales as discussed above with FIGS. 1-7.

Figure 15:
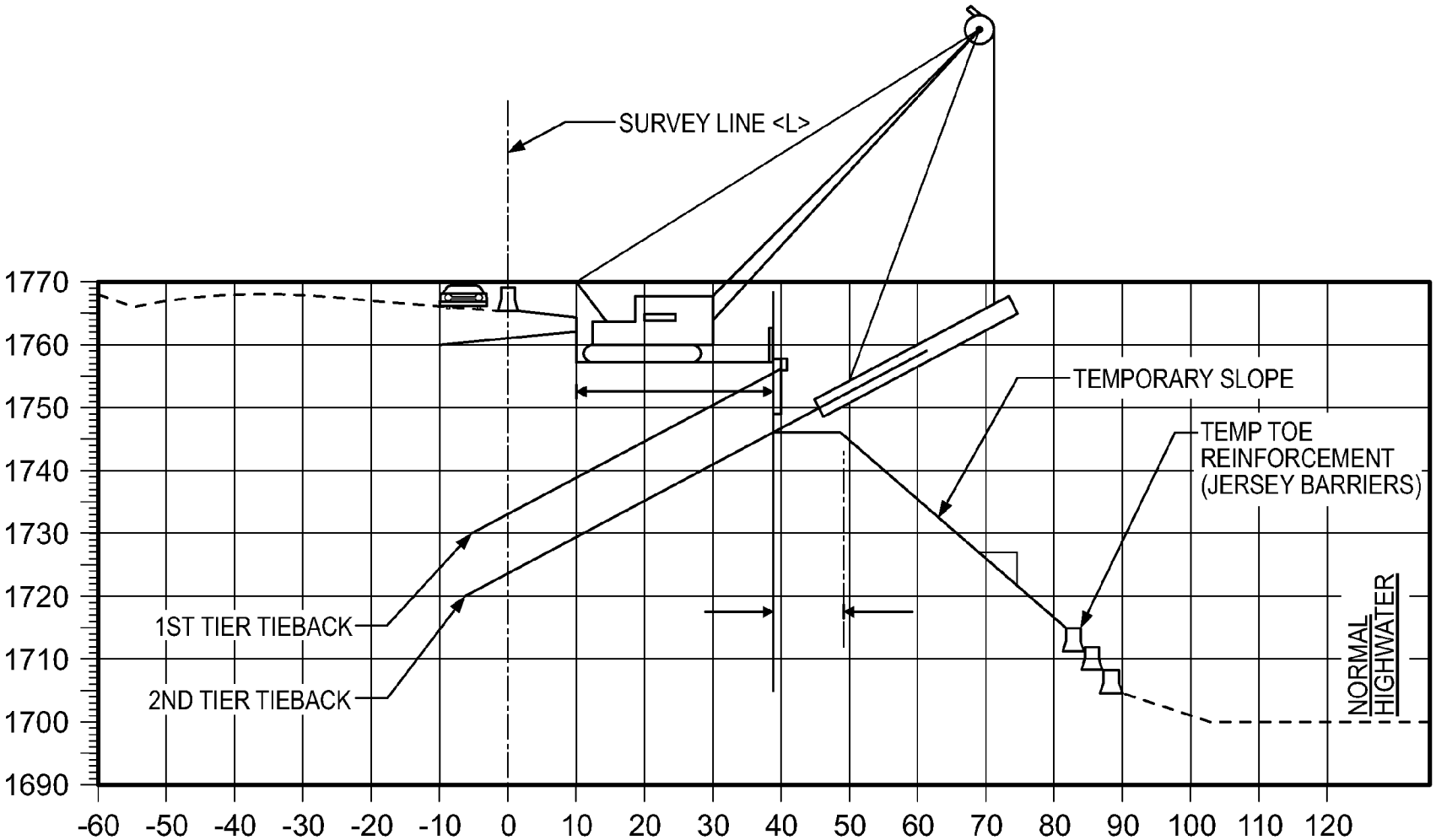
Figure 16:
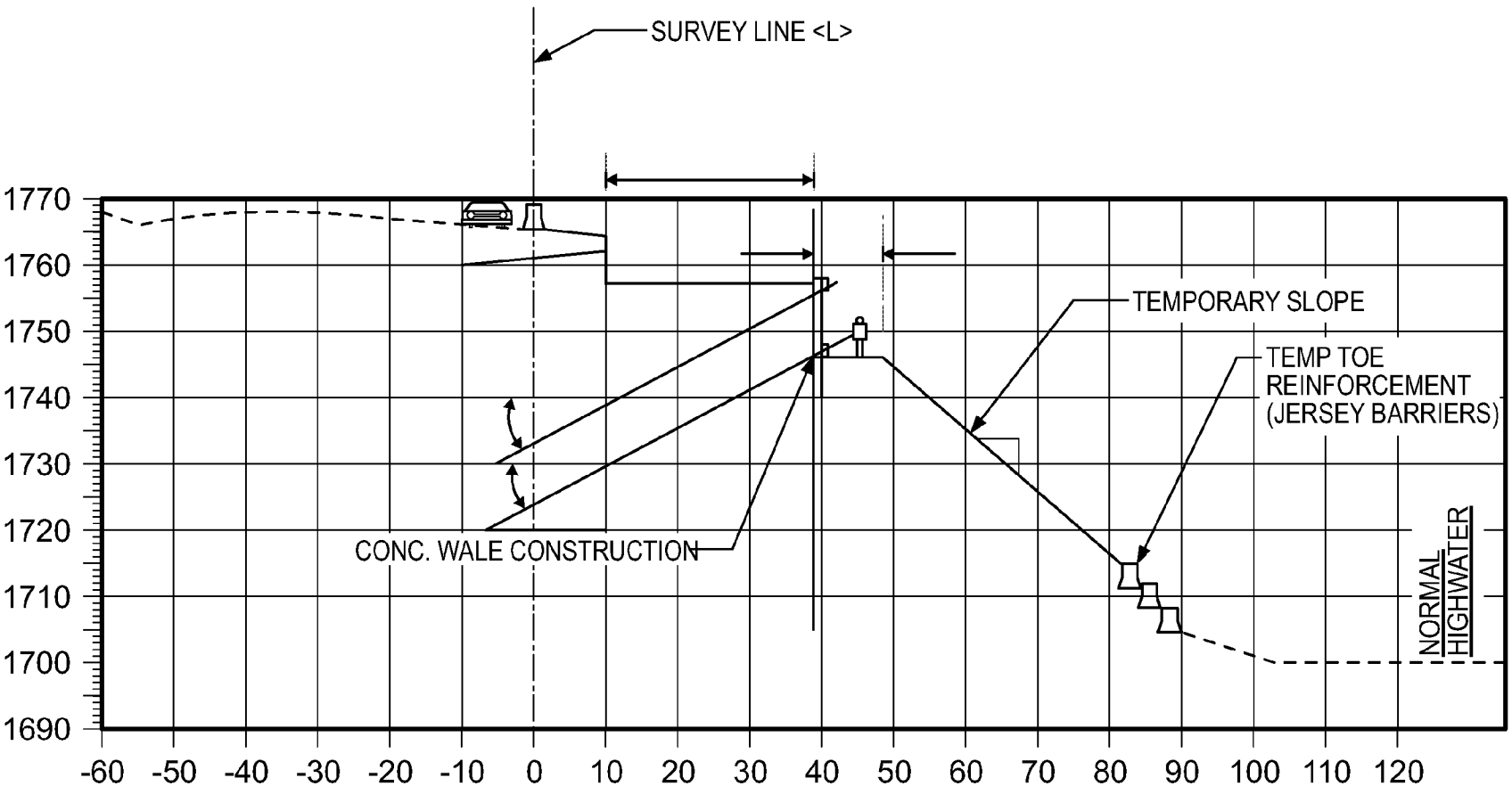

As shown in FIG. 14, the first section constructed is the top-most section of the retaining wall. Upon completion of the first section, as shown in FIGS. 15 and 16, the step 822 is performed of installing a second tier of facing, wales and then tiebacks which form the next lower section. Of course, excavation must occur as the wall continues to extend lower.

Figure 17:
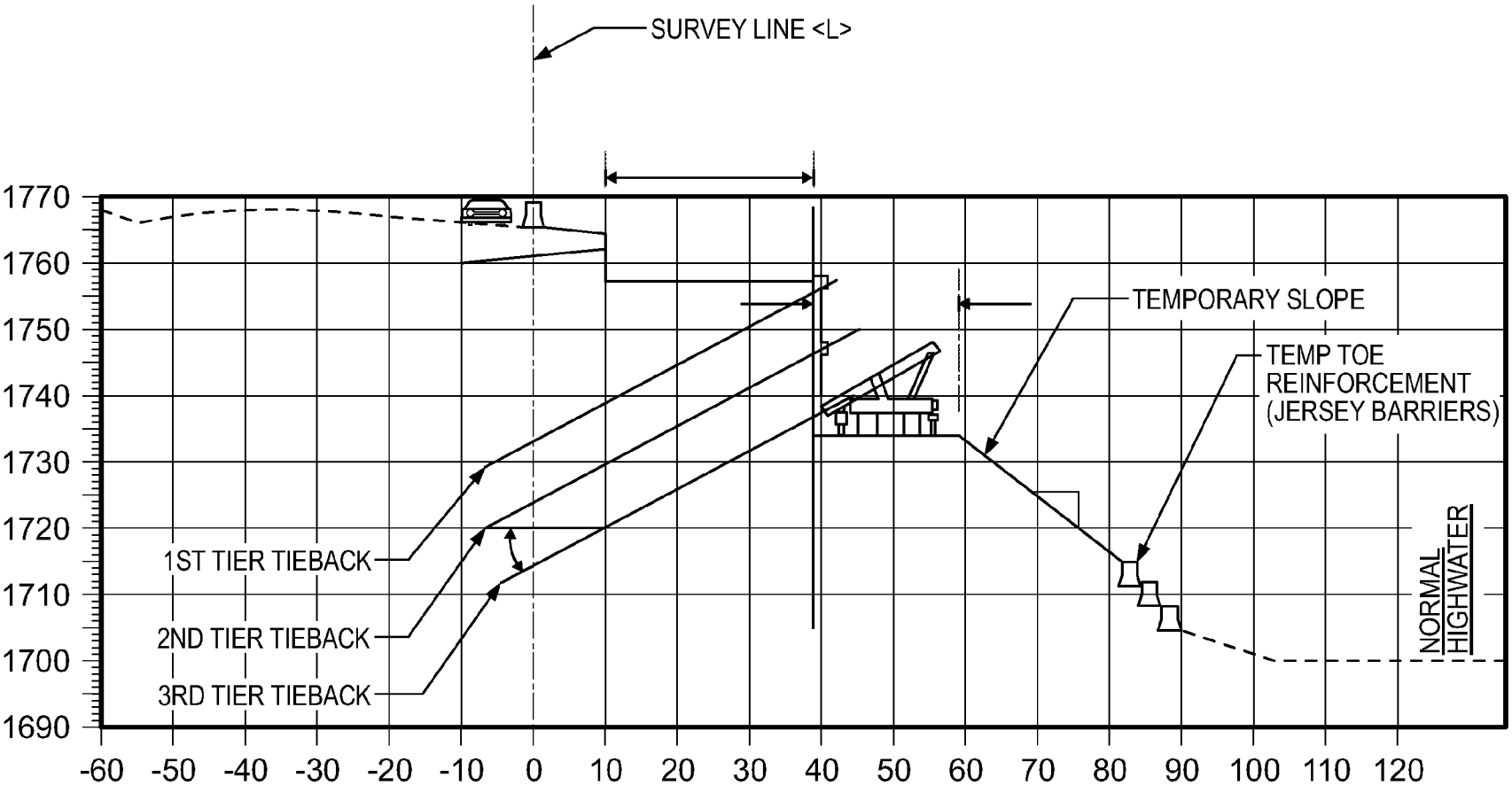
Figure 18:
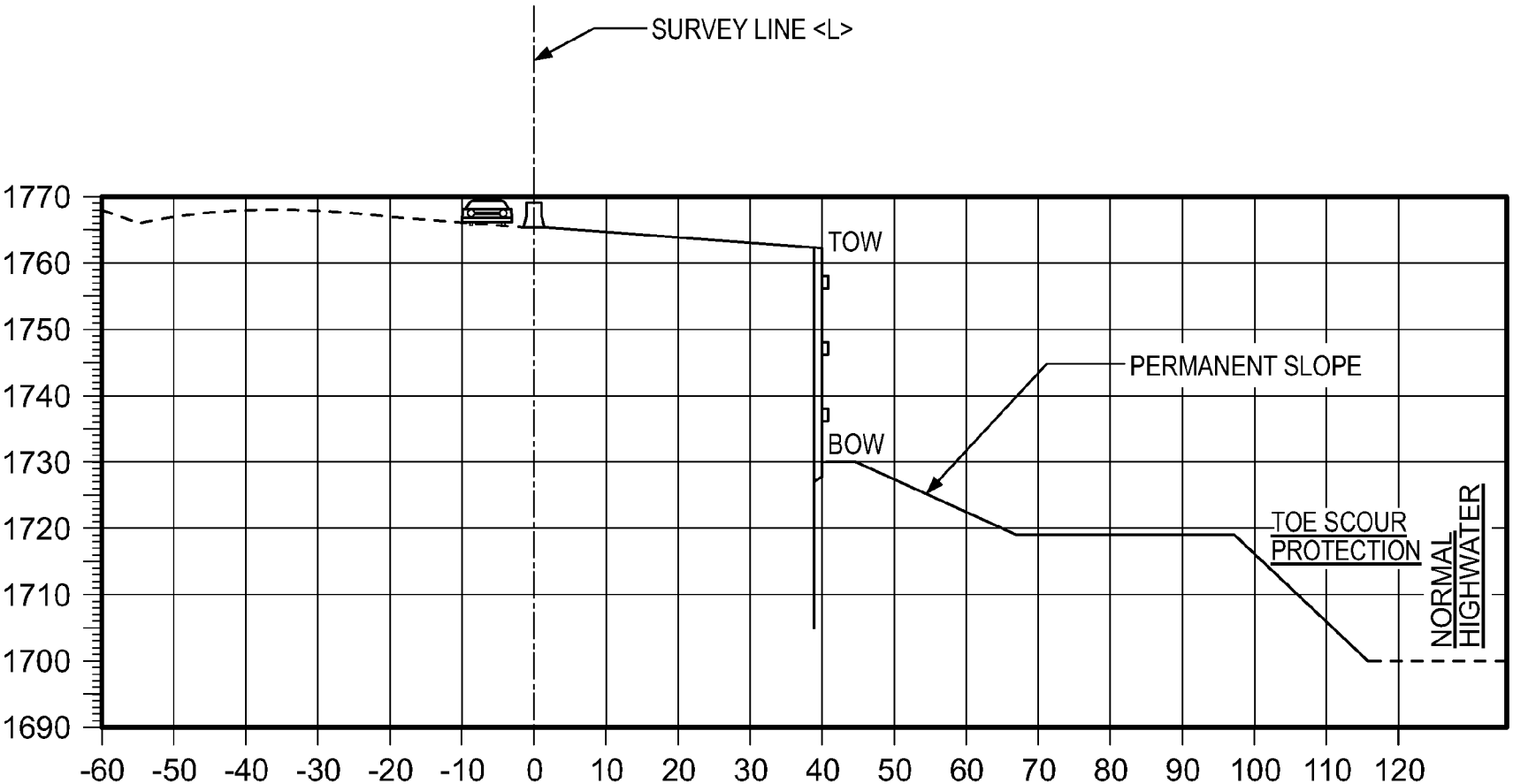

As shown in FIGS. 17 and 18, the next step 824 includes installing a third tier of tiebacks, facing and wales at a lower elevation. This step can be repeated as needed until the desired depth/retaining wall height is achieved. The retaining wall can be completed thereafter via capping the tiebacks and preparing a permanent slope in front of the wall. Although the retaining wall depicted in FIG. 18 has three completed sections constructed via top-down methods, any number of sections could be constructed to build a retaining wall at a desired height.

Thus, while there have been shown and described features of the present invention as applied to preferred embodiments thereof, it will be understood that various omissions and substitutions and changes in the form and details of the devices illustrated, and in their operation, and in the method illustrated and described, may be made by those skilled in the art without departing from the spirit of the invention as broadly disclosed herein.

What is claimed is:

1. A permanent earth retaining wall, comprising:

a row of substantially vertical micropile soldier beams, each micropile soldier beam formed from a steel tube placed in the ground;

a reinforced structural concrete wall facing section connected to each micropile soldier beam and spanning between adjacent micropile soldier beams and including at least one substantially horizontal continuous concrete wale extending substantially the length of the retaining wall, the continuous concrete wale being attached to the micropile soldier beams via a headed stud welded to the micropile soldier beams; and a plurality of tiebacks extending downward into the ground from the horizontal reinforced concrete wales, each of the plurality of tiebacks connected to the substantially horizontal reinforced concrete wale, wherein the tiebacks are under tension.

2. The permanent earth retaining wall of claim 1, wherein the reinforced structural concrete wall facing section is formed of cast-in-place reinforced structural concrete.

3. The permanent earth retaining wall of claim 1, wherein the reinforced structural concrete wall facing section is formed of reinforced structural shotcrete.

4. The permanent earth retaining wall of claim 1, wherein the substantially horizontal reinforced concrete wale is formed of cast-in-place reinforced structural concrete.

5. The permanent earth retaining wall of claim 1, wherein the substantially horizontal reinforced concrete wale is formed of reinforced structural shotcrete.

6. The permanent retaining wall of claim 1, wherein each tieback is connected to a reinforced concrete wale and extends through the wale to be anchored in a portion of the ground located behind the wale.

7. The permanent earth retaining wall of claim 1, wherein each micropile soldier beam has an outer diameter of 14 inches or less.

8. The retaining wall of claim 1, wherein the continuous concrete wale extends along the wall spanning at least three micropile soldier beams.

9. The retaining wall of claim 1, wherein the continuous concrete wale protrudes outward from the wall facing section to which it is connected.

10. The retaining wall of claim 1, wherein the micropile soldier beams include a steel tube with grout filling an interior of the tube.

11. The retaining wall of claim 1, wherein the micropile soldier beams further include additional sacrificial steel configured to allow for corrosion.

12. A permanent earth retaining wall, comprising:

a row of substantially vertical micropile soldier beams, each micropile soldier beam formed from a steel tube placed in the ground;

a first reinforced structural concrete wall facing section connected to each micropile soldier beam and spanning between adjacent micropile soldier beams and including at least a first substantially horizontal continuous concrete wale extending substantially the length of the retaining wall, the first continuous concrete wale being attached to the micropile soldier beams via a headed stud welded to the micropile soldier beams;

a first plurality of tiebacks extending downward into the ground from the first horizontal reinforced concrete wale, each of the plurality of tiebacks connected to the first substantially horizontal reinforced concrete wale, wherein the tiebacks are under tension;

a second reinforced structural concrete wall facing section connected to each micropile soldier beam and spanning between adjacent micropile soldier beams and including at least a second substantially horizontal continuous concrete wale extending substantially the length of the retaining wall, the second continuous concrete wale being attached to the micropile soldier beams via a headed stud welded to the micropile soldier beams; and a second plurality of tiebacks extending downward into the ground from the second horizontal reinforced concrete wale, each of the plurality of tiebacks connected to the second substantially horizontal reinforced concrete wale, wherein the tiebacks are under tension.

13. The permanent earth retaining wall of claim 12, wherein each micropile soldier beam is a steel pipe.

14. The permanent earth retaining wall of claim 12, wherein each micropile soldier beam is a steel tube.

15. The permanent earth retaining wall of claim 12, wherein each micropile soldier beam is a sectional steel drill casing.

16. The retaining wall of claim 12, wherein the continuous concrete wale extends along the wall spanning at least three micropile soldier beams.

17. A method of constructing a permanent earth retaining wall comprising:

installing a plurality of substantially vertical micropiles into a ground area, the plurality of substantially vertical micropiles forming a row;

excavating in front of the permanent earth retaining wall to expose the micropiles;

forming a top reinforced structural concrete wall facing section and connecting the wall facing to the micropiles;

forming at least a first horizontal reinforced structural continuous concrete wale extending substantially the length of the retaining wall, and connecting the concrete wale to the micropiles via a headed stud welded to the micropiles; and after forming the first continuous concrete wale, installing a plurality of tiebacks extending from the concrete wall facing section downward toward a portion of the ground and connecting the plurality of tiebacks to the first substantially horizontal reinforced structural continuous concrete wale, wherein the step of installing a plurality of tiebacks includes installing the tiebacks under tension.

18. The method of claim 17, further including the step of repeating the steps of:

excavating to expose the micropiles;

forming a reinforced structural concrete wall facing section and connecting the wall facing to the micropiles;

forming at least a horizontal reinforced structural continuous concrete wale extending substantially the length of the retaining wall, and connecting the concrete wale to the micropiles via a headed stud welded to the micropiles; and installing a plurality of tiebacks extending from the concrete wall facing section downward toward a portion of the ground and connecting the plurality of tiebacks to the first substantially horizontal reinforced structural continuous concrete wale, wherein the step of installing the plurality of tiebacks includes installing the tiebacks under tension;

wherein the step of repeating is performed until a predetermined height of the permanent earth retaining wall is achieved.

19. The method of claim 17, wherein the first horizontal continuous concrete wale and the top wall facing section are formed of reinforced structural shotcrete.

20. The method of claim 17, wherein the step of installing a plurality of substantially vertical micropiles into a ground area includes installing the plurality of micropiles using overburden drilling methods.

* * * * *